US009646529B2

(12) United States Patent
Lee et al.

(10) Patent No.: US 9,646,529 B2
(45) Date of Patent: May 9, 2017

(54) PREVENTING AN OVERCURRENT CONDITION IN AN ORGANIC LIGHT EMITTING DIODE DISPLAY DEVICE

(71) Applicant: LG Display Co., Ltd., Seoul (KR)

(72) Inventors: Sung-Kyu Lee, Seoul (KR); Eun-Kyung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 358 days.

(21) Appl. No.: 14/080,273

(22) Filed: Nov. 14, 2013

(65) Prior Publication Data

US 2014/0160173 A1 Jun. 12, 2014

(30) Foreign Application Priority Data

Dec. 10, 2012 (KR) ..... 10-2012-0142946

(51) Int. Cl.
*G09G 3/32* (2016.01)
*G09G 3/3225* (2016.01)

(52) U.S. Cl.
CPC ... *G09G 3/3225* (2013.01); *G09G 2320/0626* (2013.01); *G09G 2330/021* (2013.01); *G09G 2330/025* (2013.01); *G09G 2360/16* (2013.01)

(58) Field of Classification Search
CPC ..... G09G 3/3225; G09G 2330/025; G09G 2330/021
USPC ..... 345/77, 690
See application file for complete search history.

(56) References Cited

U.S. PATENT DOCUMENTS 8,063,855 B2 11/2011 Takahara et al.
2006/0208671 A1 9/2006 Ozaki et al.
2008/0180367 A1* 7/2008 Lee ..... G09G 3/3225 345/80

(Continued)

FOREIGN PATENT DOCUMENTS

CN 1794323 6/2006
CN 1835054 A 9/2006

(Continued)

OTHER PUBLICATIONS

Office Action for Chinese Patent Application No. CN 201310553252.2, Jul. 27, 2015, 15 Pages.

(Continued)

*Primary Examiner* — Jonathan Blancha
(74) *Attorney, Agent, or Firm* — Fenwick & West LLP

(57) ABSTRACT

Disclosed are an organic light emitting diode (OLED) display device and a method for driving the same, which are capable of simplifying the configuration of an overcurrent prevention circuit while preventing overcurrent generation at an image display panel, and achieving a reduction in production costs. The OLED display device includes an image data converter for analyzing input image data, to reduce the possibility of overcurrent generation and to prevent overcurrent generation, modulating image data and a grayscale voltage level (or a gamma voltage level) of a next frame when overcurrent is generated, and outputting the modulated image data and the modulated grayscale voltage (or the modulated gamma voltage), and a timing controller for arranging the image data from the image data converter to match a size of an image display panel, supplying the arranged image data to a data driver, and generating a data control signal to control the data driver.

15 Claims, 4 Drawing Sheets

(56) References Cited

U.S. PATENT DOCUMENTS

| | | | | |
|---|---|---|---|---|
| 2010/0149226 | A1* | 6/2010 | Byun | G09G 3/3225 345/690 |
| 2010/0328359 | A1 | 12/2010 | Inoue et al. | |
| 2011/0050754 | A1* | 3/2011 | Hyun | G09G 3/20 345/690 |
| 2011/0254878 | A1* | 10/2011 | Mori | G09G 3/2007 345/690 |
| 2012/0019569 | A1 | 1/2012 | Byun | |
| 2012/0044270 | A1* | 2/2012 | Arkhipov | G09G 3/32 345/690 |
| 2013/0076803 | A1* | 3/2013 | Lee | G09G 3/3233 345/690 |

FOREIGN PATENT DOCUMENTS

| | | | |
|---|---|---|---|
| CN | 1848213 | A | 10/2006 |
| CN | 1983365 | | 6/2007 |
| CN | 101046935 | A | 10/2007 |
| CN | 101217020 | | 7/2008 |
| CN | 102376253 | A | 3/2012 |
| JP | 2006-258921 | A | 9/2006 |
| JP | 2006-292817 | A | 10/2006 |
| JP | 2012-042914 | A | 3/2012 |
| TW | 200921600 | | 5/2009 |
| TW | 201115542 | A | 5/2011 |
| WO | WO 2009/008418 | A | 1/2009 |

OTHER PUBLICATIONS

Office Action for Taiwanese Patent Application No. 102139142, Mar. 26, 2015 , 11 Pages.

Japan Patent Office, Office Action, Japanese Patent Application No. 2013-250118, Sep. 30, 2014, three pages [with concise explanation of relevance].

* cited by examiner

PREVENTING AN OVERCURRENT CONDITION IN AN ORGANIC LIGHT EMITTING DIODE DISPLAY DEVICE

CROSS-REFERENCE TO RELATED APPLICATIONS

This application claims the benefit of the Korean Patent Application No. 10-2012-0142946, filed on Dec. 10, 2012 which is hereby incorporated by reference as if fully set forth herein.

BACKGROUND

1. Field of Technology

The present invention relates to an organic light emitting diode (OLED) display device and a method for driving the same, which are capable of simplifying the configuration of an overcurrent prevention circuit while preventing overcurrent generation in an image display panel, and achieving a reduction in production costs.

2. Discussion of the Related Art

Among flat panel display devices, which are an area of great interest at present, there are different types of flat panel display devices such as a liquid crystal display (LCD) device, a field emission display (FED) device, a plasma display panel (PDP) device, an organic light emitting diode (OLED) display device, etc. Among such flat panel display devices, the OLED display device is usefully applied to mobile communication appliances such as smartphones or tablet computers because it exhibits high luminance, and employs a low drive voltage while having an ultra-slim structure.

Such an OLED display device includes a plurality of pixels. Each pixel includes an OLED pixel including an anode, a cathode, an organic light emitting layer formed between the anode and the cathode, and a pixel circuit for independently driving the OLED pixel. The OLED display device also includes a driving control circuit for driving respective pixel circuits of the pixels.

In the OLED display device, a predetermined reference gamma voltage is sub-divided into gamma voltages for different grayscales. Using the sub-divided gamma voltages for different grayscales, digital data is converted into analog data signals (current or voltage signals). The analog data signals are supplied to respective pixel circuits, to enable an image to be displayed through the OLED pixels.

The luminance of each OLED pixel is determined by an amount of current flowing through the OLED pixel. Accordingly, when the brightness of an image to be displayed is increased, an increased amount of current flows through the OLED pixel. When the consumption of current in the OLED pixel is increased, power consumption of the OLED display panel is inevitably increased. As current consumption increases, the OLED display panel lifespan may be decreased.

In conventional cases, a frame current amount is controlled by storing image data in units of at least one frame, and setting maximum brightness in accordance with brightness degrees of the stored frame data such that an image is displayed at lower brightness than the maximum brightness.

However, the conventional frame current amount control method requires a separate memory to store frame data until digital data is modulated into an analog signal after setting of maximum brightness. For this reason, circuit configurations are complicated, and costs are increased. Furthermore, the time taken to modulate image data in accordance with maximum brightness on a per frame basis is lengthened.

SUMMARY

Accordingly, the present invention is directed to an organic light emitting diode display device and a method for driving the same that substantially obviates one or more problems due to limitations and disadvantages of the related art.

An object of the present invention is to provide an organic light emitting diode (OLED) display device and a method for driving the same, which are capable of simplifying the configuration of an overcurrent prevention circuit while preventing overcurrent generation at an image display panel, and achieving a reduction in production costs.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode display device includes an image display panel including a plurality of pixel regions, a data driver for driving data lines of the image display panel, an image data converter for analyzing image data input from outside of the device, to reduce a possibility of overcurrent generation and to prevent overcurrent generation, modulating image data and a grayscale voltage level (or a gamma voltage level) of a next frame when overcurrent is generated, and outputting the modulated image data and the modulated grayscale voltage (or the modulated gamma voltage), and a timing controller for arranging the image data from the image data converter to match a size of the image display panel, supplying the arranged image data to the data driver, and generating a data control signal to control the data driver.

The image data converter may include a data analyzer for analyzing grayscale distribution of the image data sequentially input to the image data converter in a unit of one frame, a gain value setting unit for extracting an average or maximum luminance value in a unit of one frame, using the analyzed grayscale distribution, calculating a luminance correction gain value sufficient to prevent a current generated through reproduction of the image data from exceeding a predetermined reference current amount, using an initial gain value according to the extracted average or maximum luminance value, and outputting the calculated luminance correction gain value, a luminance correction controller for analyzing luminance correction gain values extracted from the image data and previous frames, determining, based on results of the analysis, whether correction of display luminance is required for a reduced possibility of overcurrent generation, selecting a variation method for the luminance correction gain value when correction of display luminance is required, modulating the luminance correction gain value in accordance with the selected modulation method, and outputting the modulated luminance correction gain value, and a data voltage setting unit for generating the grayscale voltage (or the gamma voltage) or modulating the grayscale voltage level (or the gamma voltage level) in accordance with the modulated luminance correction gain value, and supplying the generated or modulated grayscale voltage (or the generated or modulated gamma voltage) to the data driver.

The image data converter may further include an overcurrent prevention unit for detecting an amount of current in a unit of at least one horizontal line or on a per frame basis, comparing the detected current amount with a predetermined reference current amount, generating or varying a data gain value to modulate the image data such that a current amount of a next frame is equal to or less than the predetermined reference current amount, when it is determined in accordance with results of the comparison that overcurrent is generated, and a data modulator for modulating the image data, using the data gain value, to generate modulated data, and supplying the modulated data to the timing controller.

The luminance correction controller may include a gain correction controller for determining whether modulation of the luminance correction gain value is required, in accordance with results of the analysis of luminance correction gain values calculated based upon the image data and previous frames, selecting a modulation method for the luminance correction gain value in accordance with results of the determination, and outputting a selection control signal according to results of the selection, a correction prevention unit for directly supplying the luminance correction gain value without modulation while being controlled in accordance with results of the modulation determination in the gain correction controller, and a plurality of correction units (or first to fourth correction units) for selectively modulating the luminance correction gain value in accordance with different modulation methods in response to the selection control signal from the gain correction controller, and outputting the modulated luminance correction gain value.

The luminance correction controller may include a gain correction controller for determining whether modulation of the luminance correction gain value is required, in accordance with results of the analysis of luminance correction gain values calculated based upon the image data and previous frames, selecting a modulation method for the luminance correction gain value in accordance with results of the determination, and outputting a selection control signal according to results of the selection, a correction prevention unit for directly supplying the luminance correction gain value without modulation, a plurality of correction units (or first to fourth correction units) for selectively modulating the luminance correction gain value in accordance with different modulation methods, and outputting the modulated luminance correction gain value, and a selection unit for supplying the luminance correction gain value from the correction prevention unit to the data voltage setting unit or supplying one of modulated luminance gain values input from the plural correction units to the data voltage setting unit, in response to the selection control signal.

In another aspect of the present invention, a method for driving an organic light emitting diode display device includes driving data lines of an image display panel including a plurality of pixel regions, analyzing image data input from outside of the device, to reduce a possibility of overcurrent generation and to prevent overcurrent generation, modulating image data and a grayscale voltage level (or a gamma voltage level) of a next frame when overcurrent is generated, and outputting the modulated image data and the modulated grayscale voltage (or the modulated gamma voltage), through an image data converter, and arranging the image data from the image data converter to match a size of the image display panel, supplying the arranged image data to a data driver, and generating a data control signal to control the data driver.

The modulating the image data and the grayscale voltage level (or the gamma voltage level), and the outputting the modulated image data and the modulated grayscale voltage may include analyzing grayscale distribution of the image data in a unit of one frame, extracting an average or maximum luminance value in a unit of one frame, using the analyzed grayscale distribution, calculating a luminance correction gain value sufficient to prevent a current generated through reproduction of the image data from exceeding a predetermined reference current amount, using an initial gain value according to the extracted average or maximum luminance value, and outputting the calculated luminance correction gain value, analyzing luminance correction gain values extracted from the image data and previous frames, determining, based on results of the analysis, whether correction of display luminance is required for a reduced possibility of overcurrent generation, selecting a variation method for the luminance correction gain value when correction of display luminance is required, modulating the luminance correction gain value in accordance with the selected modulation method, and outputting the modulated luminance correction gain value, and generating the grayscale voltage (or the gamma voltage) or modulating the grayscale voltage level (or the gamma voltage level) in accordance with the modulated luminance correction gain value, and supplying the generated or modulated grayscale voltage (or the generated or modulated gamma voltage) to the data driver.

The modulating the image data and the grayscale voltage level (or the gamma voltage level), and the outputting the modulated image data and the modulated grayscale voltage may include detecting an amount of current in a unit of at least one horizontal line or on a per frame basis, comparing the detected current amount with a predetermined reference current amount, generating or varying a data gain value to modulate the image data such that a current amount of a next frame is equal to or less than the predetermined reference current amount, when it is determined in accordance with results of the comparison that overcurrent is generated, and modulating the image data, using the data gain value, to generate modulated data, and supplying the modulated data to a timing controller.

The modulating the luminance correction gain value, and the outputting the modulated luminance correction gain value may include determining whether modulation of the luminance correction gain value is required, in accordance with results of the analysis of luminance correction gain values calculated based upon the image data and previous frames, selecting a modulation method for the luminance correction gain value in accordance with results of the determination, and outputting a selection control signal according to results of the selection, directly supplying the luminance correction gain value without modulation in accordance with control of the selection control signal, and selectively modulating the luminance correction gain value in accordance with different modulation methods in response to the selection control signal, and outputting the modulated luminance correction gain value, by use of a plurality of correction units (or first to fourth correction units).

The modulating the luminance correction gain value, and the outputting the modulated luminance correction gain value may include determining whether modulation of the luminance correction gain value is required, in accordance with results of the analysis of luminance correction gain values calculated based upon the image data and previous frames, selecting a modulation method for the luminance correction gain value in accordance with results of the determination, and outputting a selection control signal according to results of the selection, directly supplying the luminance correction gain value without modulation, selectively modulating the luminance correction gain value in accordance with different modulation methods, and outputting the modulated luminance correction gain value, by use of a plurality of correction units (or first to fourth correction units), and outputting the non-modulated luminance correction gain value or one of modulated luminance gain values input from the plural correction units in response to the selection control signal.

In the OLED display device and the method for driving the same according to the above-described aspects of the present invention, overcurrent generation in the image display panel is detected or estimated and, as such, it may be possible to prevent overcurrent generation. Accordingly, it may be possible to achieve an enhancement in the lifespan and reliability of the product.

In particular, it may be possible to reduce the possibility of overcurrent generation without provision of a separate image data storage memory. Thus, it may be possible to achieve simplification of circuit configurations and a reduction in production costs while preventing overcurrent generation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION

Reference will now be made in detail to the preferred embodiments of the present invention associated with an organic light emitting diode display device and a method for driving the same, examples of which are illustrated in the accompanying drawings.

Figure 1:
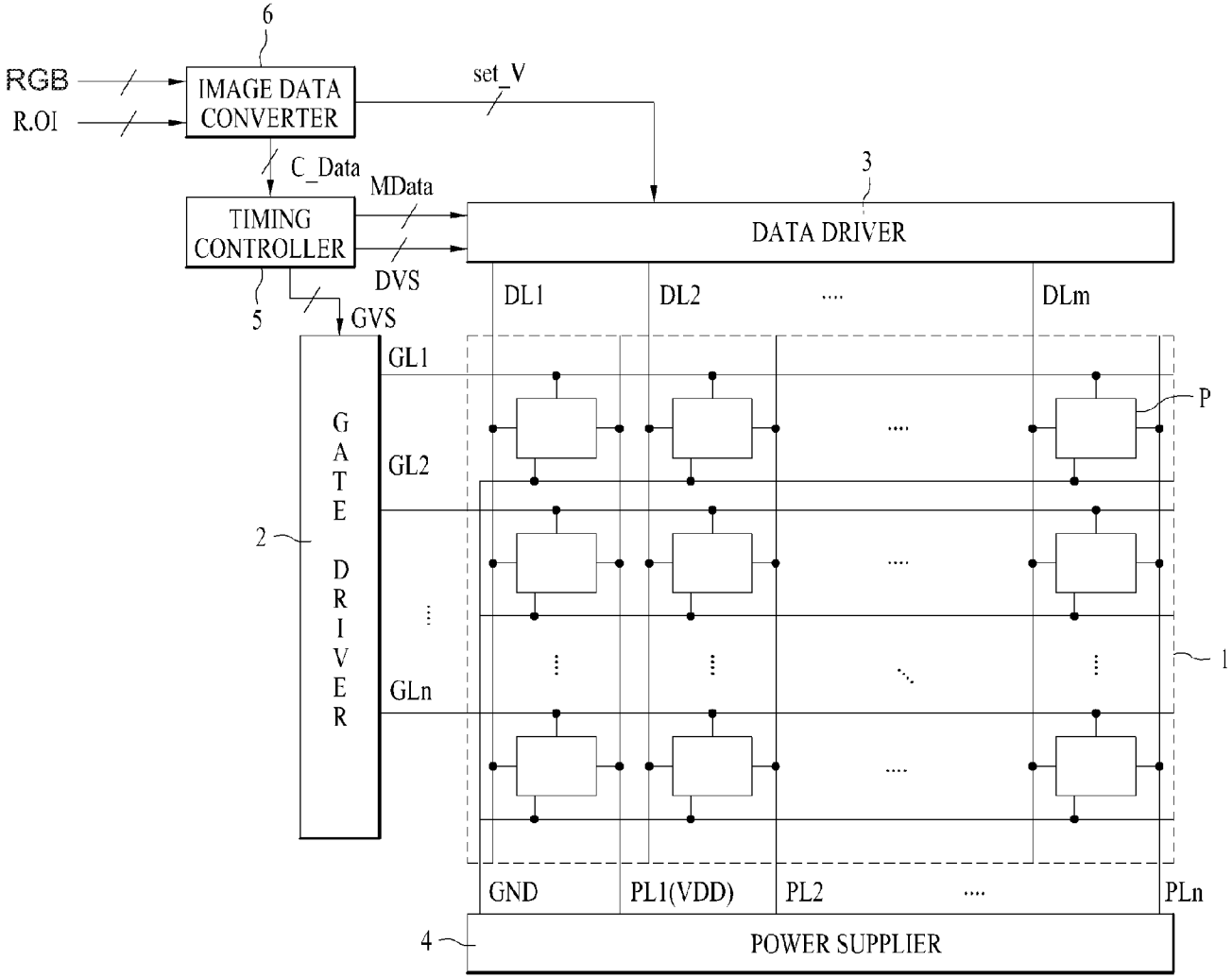
FIG. 1 is a configuration diagram illustrating an organic light emitting diode (OLED) display device according to one embodiment.

FIG. 1 is a configuration diagram illustrating an organic light emitting diode (OLED) display device according to one embodiment.

The OLED display device shown in FIG. 1 includes an image display panel 1 including a plurality of pixel regions, a gate driver 2 for driving gate lines GL1 to GLn of the image display panel 1, a data driver 3 for driving data lines DL1 to DLm of the image display panel 1, and a power supplier 4 for supplying first and second drive power signals VDD and GND to power lines PL1 to PLn of the image display panel 1. The OLED display device also includes an image data converter 6 for analyzing image data RGB input from outside of the device, to reduce the possibility of overcurrent generation and to prevent overcurrent generation, modulating (i.e., modifying) image data and a grayscale voltage level (or gamma voltage level) of a next frame when overcurrent is generated, and outputting the modulated image data and the modulated grayscale voltage set_V, and a timing controller 5 for arranging image data C_Data from the image data converter 6 to match the size of the image display panel 1, supplying the arranged image data MData to the data driver 3, and generating gate and data control signals GVS and DVS to control the gate and gate driver 2 and data driver 3.

The pixel regions of the display panel 1 are arranged in the form of a matrix, and a plurality of sub-pixels P are arranged in each pixel region, to display an image. Each sub-pixel P includes a light emitting diode, and a diode driving circuit for independently driving the light emitting diode. In detail, each sub-pixel P includes a diode driving circuit connected to one gate line GL, one data line DL, and one power line PL, and a light emitting diode connected between the diode driving circuit and the second power signal GND.

Each diode driving circuit supplies, to the light emitting diode connected thereto, an analog data signal from the data line DL connected to the diode driving circuit, to charge the light emitting diode with the analog data signal, and thus to maintain a light emission state of the light emitting diode.

The gate driver 2 sequentially generates gate-on signals in response to gate control signals GVS from the timing controller 5, for example, a gate start pulse (GSP) and a gate shift clock (GSC), while controlling the pulse width of each gate-on signal in accordance with a gate output enable (GOE) signal. The gate-on signals are sequentially supplied to respective gate lines GL1 to GLn. In this case, in a period in which no gate-on signal is supplied, a gate-off signal is supplied to each of the gate lines GL1 to GLn.

The data driver 3 converts arranged image data M_Data from the timing controller 5 into an analog voltage, namely, an analog image signal, using a source start pulse (SSP) and a source shift clock (SSC) which are included in data control signals DVS from the timing controller 5. In response to a source output enable (SOE) signal, the data driver 3 also supplies the image signal to each of the data lines DL1 to DLm. In detail, the data driver 3 latches image data M_Data received in accordance with the SSC, and generates image signals having grayscale voltage levels (or gamma voltage levels) suitable to prevent overcurrent generation in response to the SOE signal. The data driver 3 then supplies an image signal corresponding to one horizontal line to each of the data lines DL1 to DLm at intervals of one horizontal period, that is, in every horizontal period in which a scan pulse is supplied to one of the gate lines GL1 to GLn.

The power supplier 4 supplies the first and second power signals VDD and GND to the image display panel 1. Here, the first power signal VDD means a drive voltage to drive the light emitting diode, whereas the second power signal GND means a ground voltage or a low voltage. Due to a difference between the first power signal VDD and the second power signal GND, current corresponding to an image signal may flow through each sub-pixel P.

The image data converter 6 analyzes the image data RGB sequentially input thereto, and detects an amount of current on a per horizontal line basis or on a per frame basis. The image data converter 6 compares the detected current amount with a predetermined reference current amount R_OI, thereby monitoring whether overcurrent is generated. When the monitoring result indicates that overcurrent is not generated, the image data converter 6 sequentially supplies the input image data RGB to the timing controller 5 without modification. On the other hand, when the monitoring result indicates that overcurrent is generated, the image data converter 6 varies a data correction gain value and a luminance correction gain value, modulates image data of a next frame using the data correction gain value, and supplies the modulated image data to the data driver 3. Using the varied luminance correction gain value, the image data converter 6 modulates a grayscale voltage level (or gamma voltage level), and supplies the modulated grayscale voltage set_V to the data driver 3.

In addition, the image data converter 6 analyzes luminance correction gain values extracted from the image data RGB sequentially input thereto and previous frames, to reduce the possibility of overcurrent generation and to prevent overcurrent generation. In other words, the image data converter 6 sequentially supplies the input image data RGB to the timing controller 5 without modification if the analysis indicates a low possibility of overcurrent generation. However, when overcurrent is generated or the possibility of overcurrent generation is high, the image data converter 6 varies the luminance correction gain value, modifies the grayscale voltage level (or gamma voltage level), using the varied luminance correction gain value, and supplies the modulated grayscale voltage set_V to the data driver 3. In this case, the image data converter 6 also varies the data correction gain value, modulates image data of a next frame, using the varied data correction gain value, and supplies the modulated image data to the data driver 3. The image data converter 6 will be described later in more detail with reference to the accompanying drawings.

The timing controller 5 arranges image data C_Data input from the image data converter 6 to match driving of the image display panel 1 and then supplies the arranged image data MData to the data driver 3. The image data C_Data may be data modulated by a data correction gain value. The timing controller 5 also generates gate and data control signals GVS and DVS, using synchronization signals MCLK, DE, Hsync, and Vsync input from outside of the device, and supplies the gate and data control signals GVS and DVS to the gate driver 2 and data driver 3, respectively.

Figure 2:
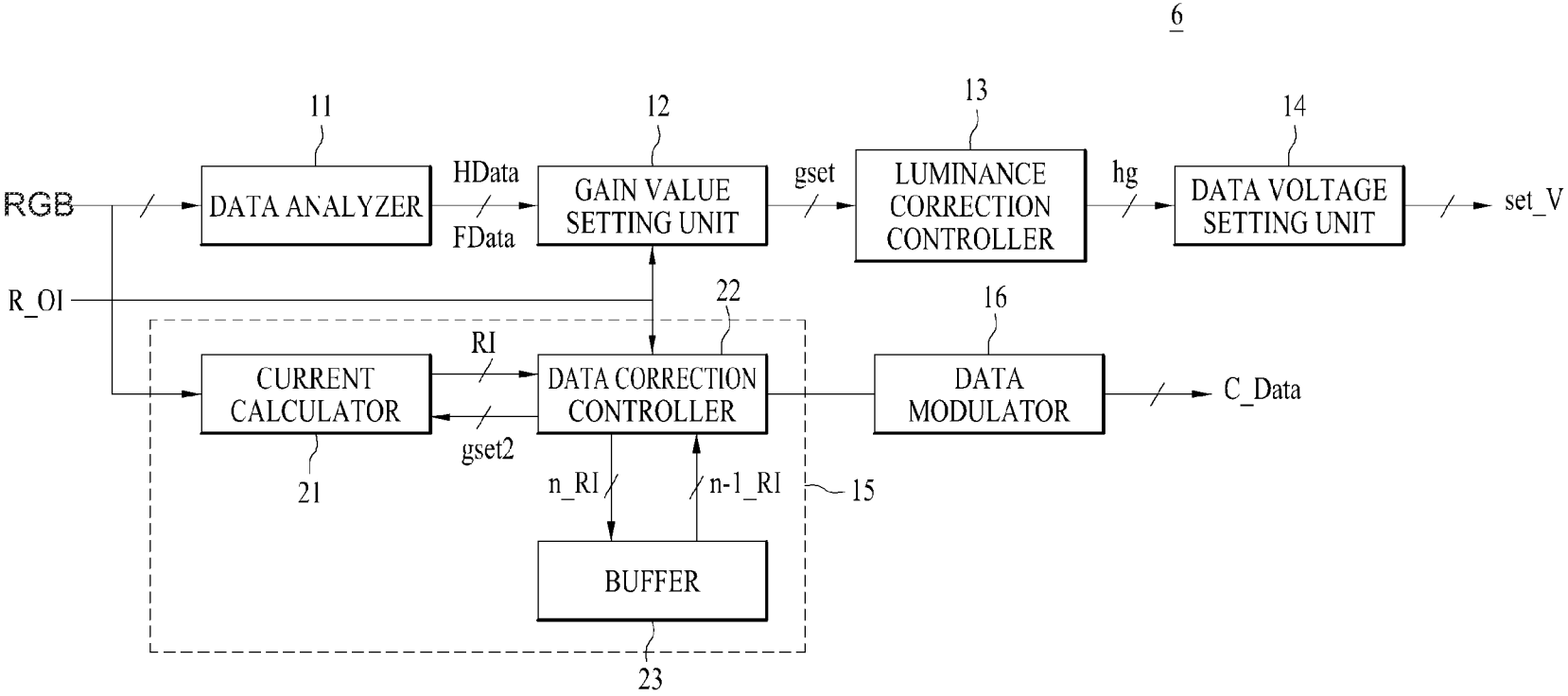
FIG. 2 is a configuration diagram illustrating one embodiment of an image data converter illustrated in FIG. 1.

FIG. 2 is a configuration diagram illustrating one embodiment of the image data converter 6 illustrated in FIG. 1.

The image data converter 6 illustrated in FIG. 2 includes a data analyzer 11 for analyzing grayscale distribution HData of the sequentially-input image data RGB on a per frame basis, and a gain value setting unit 12 for extracting an average or maximum luminance value on a per frame basis, using the analyzed grayscale distribution HData, calculating a luminance correction gain value gset sufficient to prevent the current generated through reproduction of the image data RGB from exceeding a predetermined reference current amount R_OI, using an initial gain value according to the extracted average or maximum luminance value. The image data converter 6 also includes a luminance correction controller 13 for analyzing luminance correction gain values extracted from the image data RGB and previous frames, determining, based on the results of analysis, whether correction of display luminance is required for a reduced possibility of overcurrent generation, selecting a variation method for the luminance correction gain value gset when correction of display luminance is required, varying the luminance correction gain value gset in accordance with the selected variation method, and outputting the varied luminance correction gain value gset, and a data voltage setting unit 14 for generating a grayscale voltage (or gamma voltage) or modulating (i.e., modifying) a grayscale voltage level (or gamma voltage level) in accordance with the varied luminance correction gain value, namely, a gain value hg, and supplying the generated or modulated grayscale voltage (gamma voltage) set_V to the data driver 3.

The image data converter 6 further includes an overcurrent prevention unit 15 for detecting an amount of current in units of at least one horizontal line or on a per frame basis, comparing the detected current amount with a predetermined reference current amount R_OI, generating or varying a data gain value gset2 to modulate (i.e., modify) the image data such that the current amount of the next frame is equal to or less than the predetermined reference current amount R_OI, when the comparison result indicates that that overcurrent is generated. The image data converter 6 also includes a data modulator 16 for modulating the input image data RGB, using the data gain value gset2 supplied from the overcurrent prevention unit 15, to generate modulated data C_Data, and supplying the modulated data C_Data to the timing controller 5.

The data analyzer 11 analyzes grayscale distribution HData of image data on a per frame basis by counting the number of grayscale levels of the image data or producing a histogram of grayscale levels of the image data Data. The data analyzer 11 then supplies information of the analyzed grayscale distribution HData to the gain value setting unit 12.

The gain value setting unit 12 extracts an average or maximum luminance value on a per frame basis, using the analyzed grayscale distribution HData. The gain value setting unit 12 then calculates a luminance correction gain value gset sufficient to prevent the current generated through reproduction of the image data RGB of the current frame from exceeding the predetermined reference current amount R_OI, using an initial gain value according to the extracted average or maximum luminance value, to generate the luminance correction gain value gset. For example, the gain value setting unit 12 compares the average or maximum luminance value extracted in accordance with the grayscale distribution HData or the initial gain value according to the average or maximum luminance value with the luminance value or gain value determined in accordance with the predetermined reference current amount R_OI. When the comparison result indicates that the extracted average or maximum luminance value is equal to or less than the luminance value according to the reference current amount R_OI, a luminance correction gain value of 1 or more may be generated. On the other hand, when the extracted average or maximum luminance value is greater than the luminance value according to the reference current amount R_OI, a luminance correction gain value less than 1 may be generated.

The luminance correction controller 13 analyzes luminance correction gain values gset calculated based upon the image data RGB and previous frames, and estimates the possibility of overcurrent generation. In accordance with the results of estimation, the luminance correction controller 13 determines whether correction of display luminance is required. Upon determining that display luminance correction is not required, the luminance correction controller 13 supplies the luminance correction gain value Gset from the gain value setting unit 12 to the data voltage setting unit 14 without modulation.

On the other hand, the luminance correction controller 13 selects a modulation method for the luminance correction gain value gset when overcurrent is generated or when correction of display luminance is required for a reduced possibility of overcurrent generation. As the modulation method for the luminance correction gain value gset, there may be a method of directly replacing the luminance correction gain value gset with a predetermined lower gain value, a method of reducing the luminance correction gain value gset by adding a critical value to the gain value gset or multiplying the gain value gset by a critical value, and a method of replacing the luminance correction gain value gset with a luminance correction gain value calculated based upon previous frames. Thus, the luminance correction controller 13 varies the luminance correction gain value gset, using a method selected in accordance with the results of analysis of luminance correction gain values gset calculated based upon previous frames, and supplies the varied luminance correction gain value gset to the data voltage setting unit 14.

Accordingly, the data voltage setting unit 14 generates grayscale voltages (or gamma voltages) set_V for conversion of digital image data into analog image signals, through application of final luminance correction gain values hg sequentially input from the luminance correction controller 13 in changed state or in unchanged state. The generated grayscale voltages (or gamma voltages) set_V are supplied to the data driver 3. The grayscale voltages (or gamma voltages) set_V may be additionally supplied to the overcurrent prevention unit 15.

The overcurrent prevention unit 15 of FIG. 2 includes a current calculator 21 for sequentially detecting a line current amount RI on a per horizontal line basis, and a data correction controller 22 for comparing the line current amount RI with the predetermined reference current amount R_OI, to detect overcurrent, thereby generating a data gain value gset2. The overcurrent prevention unit 15 also includes a buffer 23 for storing the current amount of a previous line or a previous frame in units of at least one horizontal line or at least one vertical line, and supplying the stored current amount to the data correction controller 22.

The overcurrent prevention unit 15 which has the above-described configuration detects a frame current amount, based on the line current amount RI calculated in units of at least one horizontal line, and compares the detected frame current amount with the predetermined reference current amount R_OI. When the comparison result indicates that overcurrent is generated, the overcurrent prevention unit 15 generates or varies a data gain value gset2 to modulate the image data RGB such that the current amount of the next frame is equal to or less than the predetermined reference current amount R_OI.

Accordingly, the data modulator 16 sequentially modulates the image data RGB, using the data gain value G, the unit of at least one horizontal line set2 supplied from the overcurrent prevention unit 15, to generate modulated data C_Data capable of preventing or reducing overcurrent generation. The data modulator 16 then supplies the modulated data C_Data to the timing controller 5.

Figure 3:
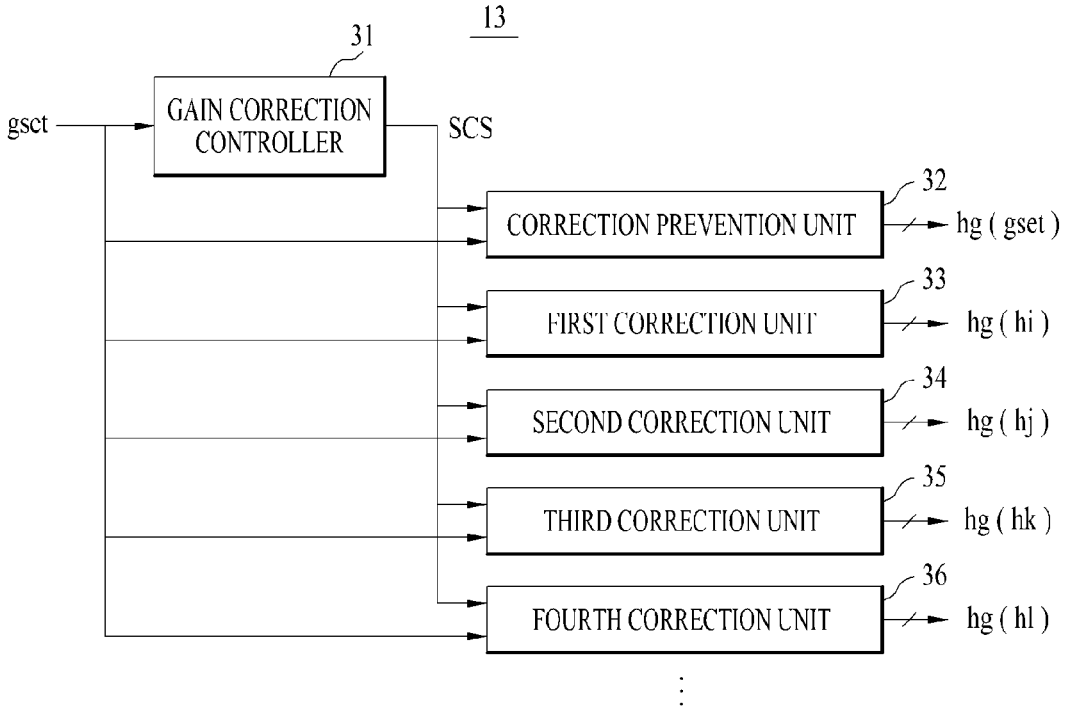
FIG. 3 is a configuration diagram illustrating one embodiment of a luminance correction controller of FIG. 2.

FIG. 3 is a configuration diagram illustrating one embodiment of the luminance correction controller 13 of FIG. 2.

The luminance correction controller 13 illustrated in FIG. 3 includes a gain correction controller 31 for determining whether modulation of the luminance correction gain value gset is required, in accordance with the results of analysis of luminance correction gain values calculated based upon the image data RGB and previous frames, selecting a modulation method for the luminance correction gain value gset in accordance with the determination result, and outputting a selection control signal SCS according to the results of selection. The luminance correction controller 13 also includes a correction prevention unit 32 for directly supplying the luminance correction gain value gset without modulation while being controlled in accordance with the results of modulation determination in the gain correction controller 31, and a plurality of correction units (for example, first to fourth correction units 33 to 36) for selectively modulating the luminance correction gain value gset in accordance with different modulation methods in response to the selection control signal SCS from the gain correction controller 31.

The gain correction controller 31 analyzes luminance correction gain values calculated based upon the image data RGB and previous frames. Upon determining that correction of display luminance is not required, the gain correction controller 31 generates and outputs a selection control signal SCS of a particular number of bits, for direct output of the luminance correction gain value gset.

The correction prevention unit 32 sets the luminance correction gain value gset without modulation, and supplies the set luminance correction gain value gset to the data voltage setting unit 14. The correction prevention unit 32 executes setting of the luminance correction gain value gset, using a correction prevention method of repeatedly re-applying a previously-calculated previous luminance correction gain value gset or a correction prevention method of using a weight average of luminance correction gain values gset calculated based upon previous frames, and supplies the set luminance correction gain value gset to the data voltage setting unit 14. When images of low grayscales below the reference current amount R_OI are continuously displayed, or images are displayed in a current amount lower than the reference current amount R_OI by a particular level, correction of display luminance is deemed not to be required, because the possibility of overcurrent generation is low.

Upon determining that correction of display luminance is required, in accordance with analysis of luminance correction gain values calculated based upon the image data RGB and previous frames, the gain correction controller 31 selects a modulation method for the luminance correction gain value gset. In this case, the gain correction controller 31 generates and outputs a selection control signal SCS of a particular number of bits corresponding to the selected modulation method. A selected one of the plural correction units (for example, the first to fourth correction units 33 to 36) corresponding to the selection control signal SCS of the particular number of bits modulates the luminance correction gain value gset using a predetermined modulation method associated with the selected correction unit and then outputs the modulated luminance correction gain value gset.

The case requiring correction of display luminance is the case in which overcurrent is generated or the possibility of overcurrent generation is high. As the modulation method for the luminance correction gain value gset, there may be a method of directly replacing the luminance correction gain value gset with a predetermined lower gain value, a method of reducing the luminance correction gain value gset by adding a critical value to the gain value gset or multiplying the gain value gset by a critical value, and a method of replacing the luminance correction gain value gset with one of the luminance correction gain values calculated based upon previous frames.

When a display image is gradually brightened on a per frame basis, the luminance gain value thereof is gradually lowered. In this case, the gain value required in a preceding frame is higher than the gain value required in a following frame. For this reason, the possibility of overcurrent generation in the following frame is increased. Accordingly, it is necessary to execute a reduction in gain value in a further preceding one of frames preceding a frame in which overcurrent will be generated. In this case, the gain correction controller 31 should generate and output a selection control signal SCS, to correct the luminance correction gain value gset in accordance with a method of directly replacing the luminance correction gain value gset with a predetermined lower gain value or a method of reducing the luminance correction gain value gset by adding a critical value to the gain value gset or multiplying the gain value gset by a critical value.

When bright and dark images are periodically repeated, overcurrent may also be periodically generated. In this case, it is necessary to maintain the gain value of the previous frame exhibiting a low luminance gain value, namely, the previous frame displayed in the form of a bright image. In this case, the gain correction controller 31 should generate and output a selection control signal SCS, to correct the luminance correction gain value gset in accordance with a method of replacing the luminance correction gain value gset with a luminance correction gain value calculated based upon a predetermined one of previous frames or a method of replacing the luminance correction gain value gset with a minimum one of luminance correction gain values calculated based on a predetermined number of previous frames.

Meanwhile, the plural correction units may include the first correction unit 33, which replaces the luminance correction gain value gset with a predetermined low gain value, and supplies the resultant luminance correction gain value to the data voltage setting unit 14, the second correction unit 34, which reduces the luminance correction gain value gset by adding a critical value to the gain value gset or multiplying the gain value gset by a critical value, and supplies the resultant luminance correction gain value to the data voltage setting unit 14, a third correction unit 35, which replaces the luminance correction gain value gset with a luminance correction gain value calculated based upon a predetermined one of previous frames, and supplies the resultant luminance correction gain value to the data voltage setting unit 14, and the fourth correction unit 36, which replaces the luminance correction gain value gset with a minimum one of luminance correction gain values calculated based on a predetermined number of previous frames, and supplies the resultant luminance correction gain value to the data voltage setting unit 14. Each of the plural correction units, namely, the first to fourth correction units 33 to 36, operates upon receiving a selection control signal SCS having a corresponding particular number of bits, replaces or generates a luminance correction gain value gset in accordance with the corresponding method, and supplies the resultant luminance correction gain value to the data voltage setting unit 14.

Accordingly, the data voltage setting unit 14 sequentially generates grayscale voltages (gamma voltages) set_V for conversion of digital image data into analog image signals through application of final luminance correction gain values hg input from the luminance correction controller 13 in changed state or in unchanged state. The grayscale voltages (gamma voltages) set_V are supplied to the data driver 3, to prevent overcurrent generation.

Figure 4:
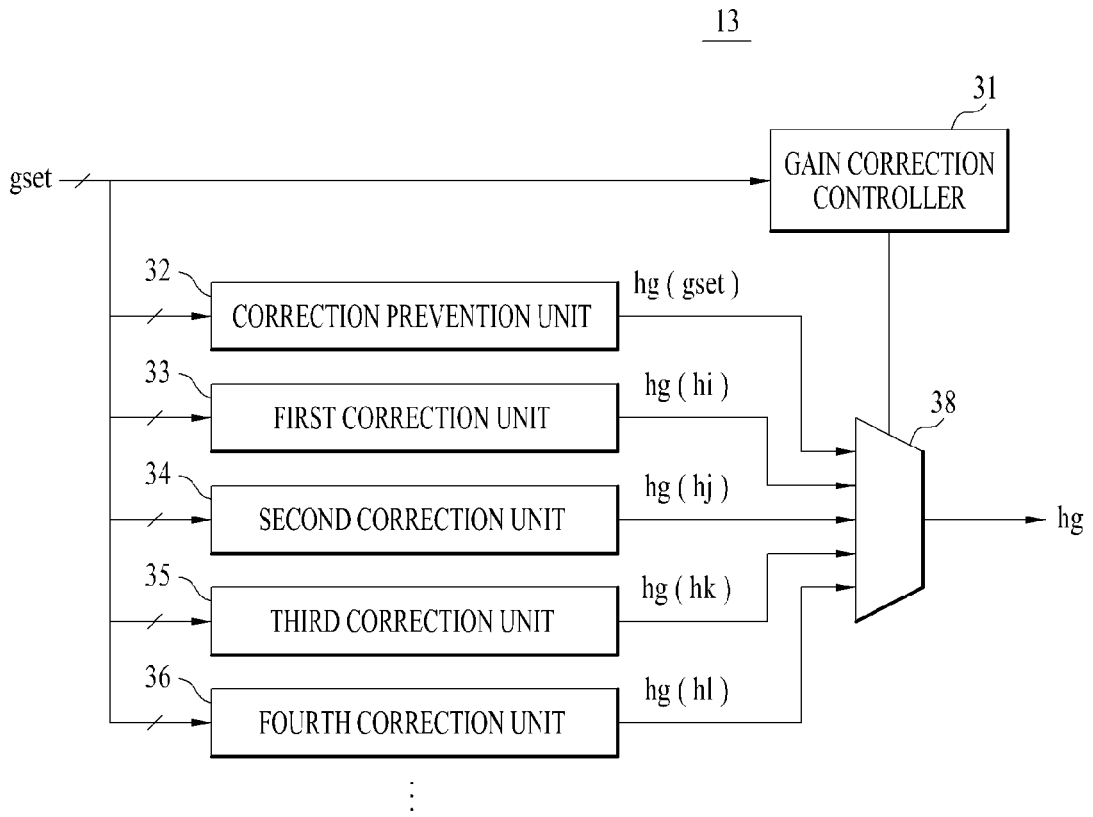
FIG. 4 is a configuration diagram illustrating another embodiment of the luminance correction controller of FIG. 2.

FIG. 4 is a configuration diagram illustrating another embodiment of the luminance correction controller of FIG. 2.

The luminance correction controller 13 illustrated in FIG. 4 includes a gain correction controller 31 for determining whether modulation of the luminance correction gain value gset is required, in accordance with the results of analysis of luminance correction gain values calculated based upon the image data RGB and previous frames, selecting a modulation method for the luminance correction gain value gset in accordance with the determination result, and outputting a selection control signal SCS according to the results of selection, and a correction prevention unit 32 for directly supplying the luminance correction gain value gset without modulation, and a plurality of correction units (for example, first to fourth correction units 33 to 36 for selectively modulating the luminance correction gain value gset in accordance with different modulation methods. The luminance correction controller 13 also includes a selection unit 38 for supplying the luminance correction gain value gset from the correction prevention unit 32 to the data voltage setting unit 14 or supplying one of modulated luminance gain values hg input from the plural correction units to the data voltage setting unit 14, in response to the selection control signal SCS.

The gain correction controller 31 analyzes luminance correction gain values calculated based upon the image data RGB and previous frames. Upon determining that correction of display luminance is not required, the gain correction controller 31 generates a selection control signal SCS of a particular number of bits, for direct outputting of the luminance correction gain value gset. On the other hand, upon determining that correction of display luminance is required, the gain correction controller 31 selects a modulation method for the luminance correction gain value gset, generates a selection control signal SCS of a particular number of bits corresponding to the selected modulation method, and supplies the selection control signal SCS to the selection unit 38.

The correction prevention unit 32 sets the luminance correction gain value gset in accordance with a correction prevention method of repeatedly re-applying a previously-calculated previous luminance correction gain value gset or a correction prevention method of using a weight average of luminance correction gain values gset calculated based upon previous frames. The correction prevention unit 32 then supplies the set luminance correction gain value gset to the data voltage setting unit 14.

Meanwhile, each of the plural correction units (for example, the first to fourth correction units 33 to 36) modulates the luminance correction gain value gset in accordance with a corresponding predetermined method, and supplies the modulated luminance correction gain value to the selection unit 38.

In response to the selection control signal SCS, the selection unit 38 supplies the luminance correction gain value gset from the correction prevention unit 32 to the data voltage setting unit 14, or supplies one of the modulated luminance correction gain values hg received from respective correction units to the data voltage setting unit 14.

Accordingly, the data voltage setting unit 14 generates grayscale voltages (or gamma voltages) set_V for conversion of digital image data into analog image signals, through application of final luminance correction gain values hg sequentially input from the luminance correction controller 13 in changed state or in unchanged state. The generated grayscale voltages (or gamma voltages) set_V are supplied to the data driver 3, to prevent overcurrent generation.

As apparent from the above description, in accordance with the embodiments herein, image data to be displayed is modulated in accordance with a frame current amount when overcurrent is generated in an image display panel. Accordingly, it may be possible to prevent overcurrent generation in the image display panel while achieving an enhancement in the lifespan and reliability of the product. In addition, the possibility of overcurrent generation is estimated to prevent overcurrent generation. Accordingly, image data may be modulated to prevent overcurrent generation without provision of a separate frame data storage memory. Thus, it may be possible to achieve simplification of circuit configurations and a reduction in production costs.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode display device comprising:

an image display panel comprising a plurality of pixel regions formed by crossings of a plurality of gate lines and a plurality of data lines of the image display panel;

an image data converter configured to:

receive first image data of a first image frame, receive second image data of a second image frame subsequent to the first image frame, determine grayscale levels of the first image data from first grayscale distribution data included in the first image data, calculate a luminance correction gain value based on an extracted luminance value from the grayscale levels of the first image data, determine whether the calculated luminance correction gain value results in an amount of current associated with the first image data that exceeds a current threshold, the current threshold indicative of an overcurrent condition of the organic light emitting diode display device, modify the calculated luminance correction gain value using a variation method selected from a plurality of different variation methods for modifying the calculated luminance correction gain value, responsive to the amount of current exceeding the current threshold, modify both the second image data of the second image frame and gray-scale voltages of the second image data, wherein the grayscale voltages of the second image data are modified using the modified luminance correction gain value, and output the modified second image data and the modified gray scale voltages; and a data driver configured to:

receive the modified second image data and the modified gray scale voltages, and drive the plurality of data lines based on the modified second image data and the modified gray-scale voltages.

2. The organic light emitting diode display device of claim 1, further comprising:

a timing controller configured to:

arrange the modified second image data outputted from the image data converter to match a size of the image display panel;

supply the arranged second image data to the data driver; and generate a data control signal to control the data driver to convert the arranged second image data into voltages representing the arranged second image data.

3. The organic light emitting diode display device of claim 1, wherein the extracted luminance value is extracted from the first image data based on the grayscale levels and wherein the extracted luminance value is an average luminance value of the grayscale levels or a maximum luminance value of the grayscale levels.

4. The organic light emitting diode display device according to claim 1, wherein the image data converter further comprises:

an overcurrent prevention unit configured to:

detect the amount of current associated with the first image data;

compare the detected amount of current with the current threshold; and modify a data gain value responsive to the comparison indicating that the detected amount of current is greater than the current threshold; and a data modulator configured to:

modify the second image data based on the modified data gain value to generate the modified second image data; and supply the modified second image data to a timing controller.

5. The organic light emitting diode display device according to claim 1, wherein the image data converter is further configured to:

generate a selection control signal corresponding to the selected variation method, and output the luminance correction gain value without modification responsive to determining that the calculated luminance correction gain value results in an amount of current less than the current threshold; and wherein the image data converter further comprises:

a plurality of correction units, each of the plurality of correction units configured to modify the luminance correction gain value based on a modulation method associated with the correction unit and to output the modified luminance correction gain value, responsive to the selection control signal.

6. The organic light emitting diode display device according to claim 5, wherein the image data converter further comprises:

a selection unit configured to selectively output the luminance correction gain value without modification or the modified luminance correction gain value.

7. The organic light emitting diode display device of claim 1, wherein the image data converter determines whether the amount of current associated with the first image data exceeds the current threshold without storing the first image data of the first frame in a frame data storage memory.

8. The organic light emitting diode display device of claim 1, wherein the plurality of different variation methods includes at least of:

a first method of replacing the luminance correction gain value with a predetermined lower gain value;

a second method of reducing the luminance correction gain value by adding a critical value to the gain value or multiplying the gain value by a critical value;

a third method of replacing the luminance correction gain value with a luminance correction gain value calculated based upon a predetermined one of previous frames; and a fourth method of replacing the luminance correction gain value with a minimum one of luminance correction gain values calculated based on a predetermined number of previous frames.

9. A method for driving an organic light emitting diode display device including an image display panel, the method comprising:

receiving first image data of a first image frame;

receiving second image data of a second image frame subsequent to the first image frame;

determining grayscale levels of the first image data from first grayscale distribution data included in the first image data;

calculating a luminance correction gain value based on an extracted luminance value from the grayscale levels of the first image data;

determining whether the calculated luminance correction gain value results in an amount of current associated with the first image data that exceeds a current threshold, the current threshold indicative of an overcurrent condition of the organic light emitting diode display device;

modifying the calculated luminance correction gain value using a variation method selected from a plurality of different variation methods for modifying the calculated luminance correction gain value, responsive to the amount of current exceeding the current threshold;

modifying both the second image data of the second image frame and gray-scale voltages of the second image data, wherein the grayscale voltages of the second image data are modified using the modified luminance correction gain value; and driving the plurality of data lines based on the modified second image data and the modified gray-scale voltages.

10. The method according to claim 9, further comprising:

arranging the modified second image data to match a size of the image display panel; and generating a data control signal to convert the arranged second image data into voltages representing the arranged second image data.

11. The method of claim 9, wherein the luminance value is extracted from the first image data based on the grayscale levels and wherein the extracted luminance value is an average luminance value of the grayscale levels or a maximum luminance value of the grayscale levels.

12. The method according to claim 9, wherein modifying both the second image data of the second image frame and the gray-scale voltages of the second image data comprises:

detecting an amount of current associated with the first image data;

comparing the detected amount of current with the current threshold;

modifying a data gain value responsive to a comparison indicating that the detected amount of current is greater than the current threshold; and modifying the second image data based on the modified data gain value to generate the modified second image.

13. The method according to claim 9, further comprising:

outputting the luminance correction gain value without modification responsive to determining that the calculated luminance correction gain value results in an amount of current less than the current threshold.

14. The method of claim 9, further comprising determining the amount of current associated with the first image data without storing the first image data of the first frame in a frame data storage memory.

15. The method of claim 9, wherein the plurality of different variation methods includes at least of:

a first method of replacing the luminance correction gain value with a predetermined lower gain value;

a second method of reducing the luminance correction gain value by adding a critical value to the gain value or multiplying the gain value by a critical value;

a third method of replacing the luminance correction gain value with a luminance correction gain value calculated based upon a predetermined one of previous frames; and a fourth method of replacing the luminance correction gain value with a minimum one of luminance correction gain values calculated based on a predetermined number of previous frames.

* * * * *